United States Patent [19]

Bleakley

[11] 4,248,215

[45] Feb. 3, 1981

[54] CRANIAL TENSION RELIEVER

[76] Inventor: Robert D. Bleakley, Sunnyside, Forrest Reefs Rd., Millthorp, N.S.W., Australia

[21] Appl. No.: 26,029

[22] Filed: Apr. 2, 1979

Related U.S. Application Data

[63] Continuation of Ser. No. 774,108, Mar. 3, 1977, abandoned.

[51] Int. Cl.[3] ..... A61H 7/00; A61H 23/04

[52] U.S. Cl. ..... 128/60; 128/64; 128/97; 128/163

[58] Field of Search ..... 128/24 R, 163, DIG. 20, 128/59, 60, 38, 39, 40, 64, 87 R, 76 R, 97, 303 R, 327; 272/94, 95; 2/DIG. 11, DIG. 10, 171.2

[56] References Cited

U.S. PATENT DOCUMENTS

| | | | |
|---|---|---|---|
| 924,596 | 6/1909 | Blashfield | 128/163 |
| 937,596 | 10/1909 | Gray et al. | 128/97 |
| 1,147,560 | 7/1915 | Shurtleff | 128/24 R |
| 1,795,893 | 3/1931 | Rosett | 128/DIG. 20 |
| 2,571,461 | 10/1951 | Livingston et al. | 128/327 |
| 2,571,461 | 10/1951 | Livingston et al. | 128/327 |
| 2,614,565 | 10/1952 | Packer | 128/327 |
| 2,664,884 | 1/1954 | La Verne | 128/59 |
| 3,094,118 | 6/1963 | Besme et al. | 128/64 |
| 3,101,085 | 8/1963 | Murphy, Jr. | 128/24 R |
| 3,159,160 | 12/1964 | Ullom | 2/171.2 |
| 3,454,010 | 7/1969 | Lilligren et al. | 128/327 |
| 3,457,913 | 7/1969 | Schöpfel | 128/40 |
| 3,570,495 | 3/1971 | Wright | 128/327 |
| 3,633,567 | 1/1972 | Sarnoff | 128/327 X |
| 3,906,937 | 9/1975 | Aronson | 128/327 X |

FOREIGN PATENT DOCUMENTS

| | | | |
|---|---|---|---|
| 952782 | 8/1974 | Canada | 128/327 |
| 443601 | 12/1948 | Italy | 128/24 R |
| 20825 | of 1908 | United Kingdom | 128/163 |
| 403859 | 1/1934 | United Kingdom | 128/327 |
| 183896 | 8/1966 | U.S.S.R. | 128/87 R |

*Primary Examiner*—Robert W. Michell
*Assistant Examiner*—Arthur S. Rose
*Attorney, Agent, or Firm*—McDougall, Hersh & Scott

[57] ABSTRACT

Apparatus for relieving cranial tension comprising a head band having multiple diametrically disposed expandable compartments on the inner face of the head band, and an alternating pump for introducing and removing fluid under pressure for expansion and contraction of said compartments while in contact with the head.

5 Claims, 3 Drawing Figures

CRANIAL TENSION RELIEVER

This is a continuation of application Ser. No. 774,108, filed Mar. 3, 1977, now abandoned.

This invention relates to apparatus for relieving cranial tension, particularly, but not exclusively, in human beings.

In its broadest aspect, the present invention provides apparatus for relieving cranial tension, said apparatus comprising means for encircling a cranium and adapted to fit snugly therearound, at least one expandible compartment associated with said cranium encircling means for applying pressure to a portion of the cranium, and means for expanding and contracting said or each compartment.

The invention is predicated upon the discovery that the application of intermittent pressure to various parts of a cranium can alleviate or eliminate tension which is frequently the cause of headaches. It is believed that the application of pressure forces the sutures in the skull to close and the removal of the pressure permits the sutures to open, and that tension in the occipitofrontalis muscle is thereby relieved. While the foregoing is the presently prevailing theory relating to the relief of cranial tension, it is to be understood that the present invention in no way relies on the validity of that theory.

The cranium encircling means of the apparatus of the invention preferably encompasses the cranium and passes across the brow in a plane approximately parallel to the eye-ear place. The eye-ear plane is that formed by drawing an imaginary straignt line through the eye and the ear of the head of a human being, observed in profile. It is also preferred that the cranium encircling means leaves the eye and the ear areas of the patient free. It is also within the scope of this invention that the cranium encircling means may encompass the suboccipital region of the cranium.

In accordance with the above-described preferred embodiment, the cranium encircling means may resemble a headband which does not cover the vertex of the cranium, or alternatively the cranium encircling means may include a portion designed to enclose the vertex or even the whole cranium, in which case the cranium encircling means may resemble a cap or a helmet.

The material from which the cranium encircling means is manufactured can be any suitable material, especially a material chosen from the group consisting of rubber, rubber substitutes, metal, woven textile fabric, fibreglass, synthetic plastics and mixtures of the foregoing.

The expandible compartment or compartments are designed to apply pressure to the cranium intermittently and preferably each expandible compartment comprises an inflatable pouch associated with the cranium encircling means. It is especially preferred that each inflatable pouch is incorporated in the cranium encircling means to form part thereof.

As stated hereinabove, the apparatus of the invention includes at least one expandible compartment. When only one such compartment is employed it must be large enough to be effective in the application of pressure to the cranium. At the other end of the scale, the compartment may be so large as to cover all or nearly all of the cranium.

In addition more than one expandible compartment can be associated with the apparatus and if desired the apparatus can be designed so than an expandible compartment is sited on or near various parts of the cranium including on the vertex.

When the expandible compartment is in the preferred form of an inflatable pouch, the pouch must be capable of itself bearing on at least a portion of the cranium when inflated, or else the inflation of the pouch must have the effect of causing the cranium encircling means to tighten on the cranium. Inflation of the pouch may of course produce a combination of these two effects. It is within the scope of this invention that the cranium encircling means incorporate a continuous inflatable pouch which also encompasses the cranium, or that there are a number of separate inflatable pouches incorporated in the cranium encircling means.

The function of the expanding and contracting means is to expand the expandible compartment and alternatively contract the compartment from its expanded position, thus applying pressure to the cranium when the compartment is expanded and releasing the pressure when the compartment is contracted. Therefore when the expandible compartment comprises an inflatable pouch, the expanding means most conveniently consists of a pump for pumping gas or liquid into the pouch to cause inflation thereof. Similarly, in this case the contracting means may be pressure release means such as one or more pressure release valves.

The apparatus of the invention may be operated manually (for example by means of a "bulb" type pump and a manual valve release) or automatically, such as by electric time release pressure regulators, or by a hand-held electric switch mechanism.

It is especially preferred that the cranium encircling means of the apparatus of this invention is adjustable so that it may be tightened or loosened on a cranium and so that it can accommodate craniums of various sizes. Adjustment may be effected in any suitable manner; it has been found that the use of a VELCRO (Registered Trade Mark) closure is advantageous in that it cannot cause discomfort to the patient.

The invention will now be described with referene to two embodiments thereof, illustrated in the accompanying drawing, in which.

Figure 1:
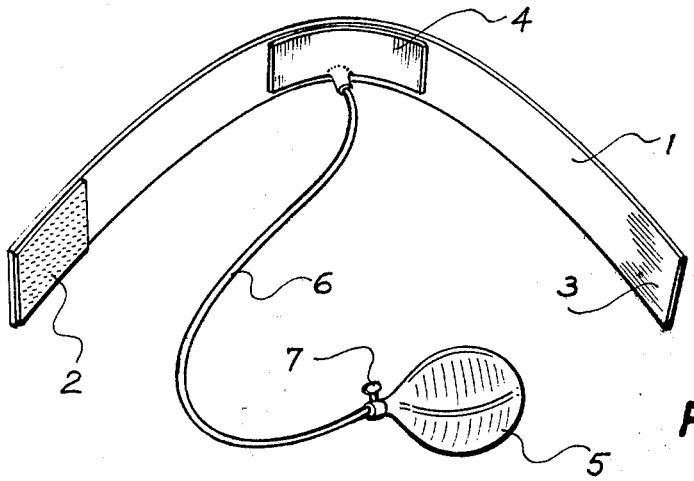
FIG. 1 is a perspective view of a first embodiment of the apparatus of the invention.

Referring now to FIG. 1, the apparatus comprises headband 1, made of thick rubber and adapted to encircle the brow of a patient. Headband 1 has at each end thereof cooperating VELCRO (Registered Trade Mark) closures 2 and 3 for adjusting the headband snugly around the head. Inflatable pouch 4 is formed in headband 1 and communicates with pressure bulb 5 via tube 6. Pressure bulb 5 also incorporates a pressure release view valve (not shown) operable by pin 7.

To use the apparatus shown in FIG. 1, headband 1 is fastened around the cranium of a patient by means of closures 2 and 3, so that inflatable pouch 4 is positioned on the brow of the patient. Air is pumped from pressure bulb 5 (by manipulation thereof) through tube 6 into the pouch 4. As pouch 3 fills with air it bears on the patient's brow and also causes headband 1 to tighten around the cranium. After the pouch 4 has been fully inflated, pin 7 is depressed and the air in pouch 4 and tube 6 is allowed to flow back into bulb 5, thus deflating pouch 4. This action relieves the pressure of pouch 4 and headband 1 on the patient's cranium and brow. The pumping and release sequence is repeated until the desired result is obtained.

It should be mentioned here that the effectiveness of the apparatus of the invention depends to a large extent on the quantity of cranial tension and the period of time during which the cranium has been in tension. Thus it is found that the apparatus of the invention will relieve cranial tension after only a few minutes of operation in some cases, whereas up to an hour or more of operation may be required in severe cases.

In addition where cranial tension has been caused by physical shock, such as by a blow on the head, manipulation of the cranium prior to use of the apparatus of the invention may be required to completely relieve cranial tension.

Figure 2:
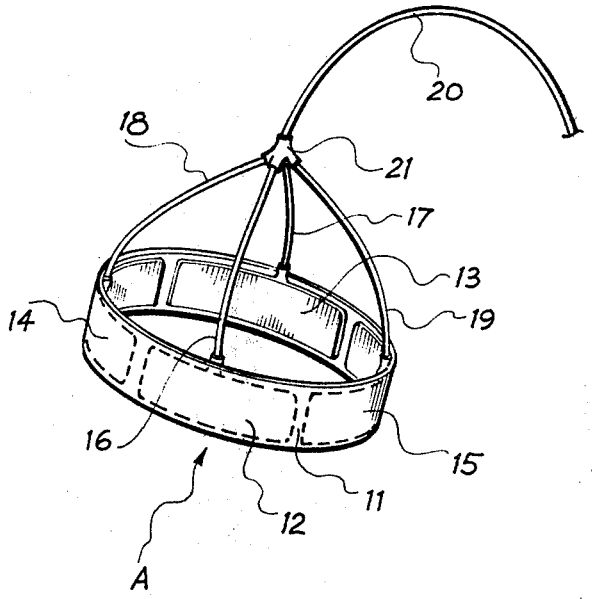
FIG. 2 is a perspective view of a second embodiment of the apparatus of the invention.
Figure 3:
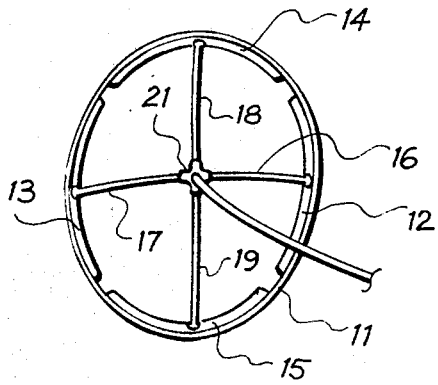
FIG. 3 is a plan view of the apparatus in FIG. 2, looking in direction A.

Turning now to FIGS. 2 and 3, band 11 is manufactured from fibreglass and is shaped to encircle the cranium of a patient, including the brow. Band 11 incorporates therein a pair of lateral inflatable pouches 12 and 13, an anterior pouch 14 and a posterior pouch 15. All four pouches are connected to an electrically operated time sequence pump mechanism 22 via electrical wiring and air tubes located in conduits 16, 17, 18 and 19, which are enclosed in a common casing 20 at 21.

During use of the apparatus in FIGS. 2 and 3, band 11 encircles the patient's cranium and the pump mechanism causes lateral pouches 12 and 13 to expand while anterior and posterior pouches 14 and 15 are deflated. Subsequently lateral pouches 12 and 13 are deflated and pouches 14 and 15 are inflated. As this sequence is repeated, the patient experiences alternately pressure on the sides of his cranium followed by pressure on his brow and the back of his cranium. This alternating pressure has proved very effective in relieving cranial tension.

If desired, the apparatus illustrated in FIGS. 2 and 3 may be enclosed in an opaque casing to increase its aesthetic appeal.

I claim:

1. A method for relieving cranial tension comprising encircling the cranium with a head band having an inner face adapted to be positioned alongside the cranium, having a first pair of oppositely located lateral expandable compartments on the inner face of the head band, and an anterior and posterior pair of expandable compartments on the inner face of the head band, securing the head band on the cranium in an encircling position in a plane parallel with the plane defined by the eyes and ears and to minimize lengthwise expansion and contraction, sequentially introducing fluid under pressure into only one of said pairs of compartments for applying pressure only in the direction perpendicular to the surface of the portion of the head engaged by said one pair of compartments while removing fluid from only the other of said pairs of compartments for depressurization and introducing fluid under pressure into only the other of said pairs of compartments for applying pressure only in the direction perpendicular to the surface of the portion of the head engaged by said other pair of compartments while removing fluid from said one pair of compartments for depressurization.

2. The method as claimed in claim 1 wherein said cranium encircling head band encompasses said cranium including the brow in a plane approximately parallel to the eye-ear plane.

3. The method as claimed in claim 1 wherein said cranium encircling head band is manufactured from a material chosen from the group consisting of rubber, rubber substitutes, metal, woven textile fabric, fiberglass, synthetic plastics and mixtures thereof.

4. The method as claimed in claim 1 wherein each of said expandable compartments comprises an inflatable pouch.

5. The method as claimed in claim 1 wherein said cranium encircling head band is adjustable in length.

* * * * *